United States Patent [19]

Alexander

[11] 4,071,270

[45] Jan. 31, 1978

[54] MORTISE LOCK HAVING INTERNAL AUXILIARY SPRING FOR LEVER

[75] Inventor: Gordon A. Alexander, Newington, Conn.

[73] Assignee: Emhart Industries, Inc., Farmington, Conn.

[21] Appl. No.: 730,948

[22] Filed: Oct. 8, 1976

Related U.S. Application Data

[63] Continuation of Ser. No. 542,281, Jan. 20, 1975.

[51] Int. Cl.[2] ..... F05C 1/16

[52] U.S. Cl. ..... 292/169.22

[58] Field of Search ..... 292/1, 69.11, 69.12, 292/69.13, 69.14, 69.15, 69.16, 69.17, 69.18, 69.19, 69.21, 69.22, 69.23, 244, 245, 336.3, 336.5; 70/380, 462

[56] References Cited

U.S. PATENT DOCUMENTS

| | | | |
|---|---|---|---|
| 606,246 | 6/1898 | Russell | 292/336.5 |
| 1,564,463 | 12/1925 | Best | 70/380 |
| 1,857,684 | 5/1932 | Flynn | 292/169.15 |
| 2,262,133 | 11/1941 | Blessin | 292/169.21 |
| 3,708,191 | 11/1973 | Hegedus | 292/1 |
| 3,811,717 | 5/1974 | Floyd et al. | 292/92 |

FOREIGN PATENT DOCUMENTS

| | | | |
|---|---|---|---|
| 1,541,405 | 4/1968 | France | 70/380 |
| 530,411 | 10/1921 | France | 292/336.5 |
| 686,945 | 2/1958 | United Kingdom | 292/336.5 |

OTHER PUBLICATIONS

Sargent and Company—Drawing No. 81-2516 Tab of 1-14-63.

Sargent and Company—Drawing No. 81-0249 of 5-20-68.

Sargent and Company—Drawing No. 81-2605 of 5-31-68.

Sargent and Company 8100 Series Parts Catalog of 6-66.

Sargent and Company—1965 Condensed Catalog, p. 11, Found in 1965, Sweet's Architectural File, Section 19e/sar.

*Primary Examiner*—Roy D. Frazier
*Assistant Examiner*—Thomas J. Holko
*Attorney, Agent, or Firm*—McCormick, Paulding & Huber

[57] ABSTRACT

A mortise lock operated by a two-directional inner knob and an outer lever handle has means within its case to limit rotation of the outer lever handle in one direction. An auxiliary hub spring also contained in the case and associated with the outer rollback hub provides additional yieldable resistance to rotation of the lever handle in said one direction to compensate for the movement of the lever handle which results from its radially offset center of gravity. The auxiliary hub spring also provides additional reactive torque to compensate for increased mechanical advantage attained through utilization of a lever handle.

13 Claims, 10 Drawing Figures

MORTISE LOCK HAVING INTERNAL AUXILIARY SPRING FOR LEVER

This is a continuation, of application Ser. No. 542,281 filed Jan. 20, 1975.

BACKGROUND OF THE INVENTION

This invention relates in general to mortise latches and deals more particularly with a mortise latch of the type which has a case, a normally projected latch bolt, inner and outer hubs journalled within the case for independent coaxial rotation and means for retracting the latch bolt in response to rotation of either of the hubs in at least one direction relative to the case. Latches of the aforedescribed general type may be set-up for inner and outer knob or lever handle operation or combinations thereof. If a latch is arranged for two-directional knob operation, it is generally desirable that knob action be balanced, that is that both hubs offer substantially uniform resistance to operational torque in either direction. However, if either hub is to be arranged for lever handle operation some auxiliary spring means is usually required to compensate for the moment of the lever handle which results from its center of gravity being radially offset from its axis of rotation. Further, since a lever handle usually offers substantially greater mechanical advantage than a knob, it is generally desirable that a lever handle have somewhat greater resistance to operational torque than a knob to compensate for its greater mechanical advantage and to provide a desired degree of reactive response to manual operation.

Heretofore, it has been generally customary to provide auxiliary spring means associated with the lever handle assembly or more particularly with a rose or escutcheon which comprises a part of the assembly. However, such a special feature within the lever handle assembly adds substantially to its cost. Further, a lever handle assembly having such a special feature must generally be handed, all of which further significantly increases the cost of providing the desired latch functions. Accordingly, it is the general aim of this invention to provide a substantially universal mortise latch structure which may be readily adapted to either knob or lever handle operation during manufacture or in the field and at minimal expense.

SUMMARY OF THE INVENTION

In accordance with the present invention, a mortise latch which has a case, a retractable latch bolt, inner and outer hubs journalled in the case for independent coaxial angular movement, and means for retracting the latch bolt in response to angular movement of either of the hubs in at least one direction relative to the case, is provided with means within the case for limiting angular movement of at least one of the hubs in at least one direction and an auxiliary biasing spring within the case for resisting angular movement of the one hub in said one direction. A spacer partially disposed between the inner and outer hubs cooperates with the auxiliary spring to positively retain it in an associated portion of the case. The spacer may also provide support for an associated portion of a movable stop member which comprises part of a stop works.

DETAILED DESCRIPTION OF THE PREFERRED EMBODIMENT

The present invention may be practiced with a mortise latch of the type which includes a case supporting a retractable latch bolt and containing inner and outer hubs journalled for independent coaxial angular movement relative to the case and means for retracting the latch bolt in response to angular movement of either of the hubs in at least one direction relative to the case. In accordance with the present invention, at least one of the hubs is adapted for operation by a lever handle which has its center of gravity radially offset from its axis of rotation. Means is provided within the case to limit the angular movement of the one hub in one direction. Auxiliary biasing means is also provided within the case to increase torque resistance of the one hub in the one direction whereby to counteract the moment of the lever handle and provide a desired degree of reactive torque.

Figure 1:
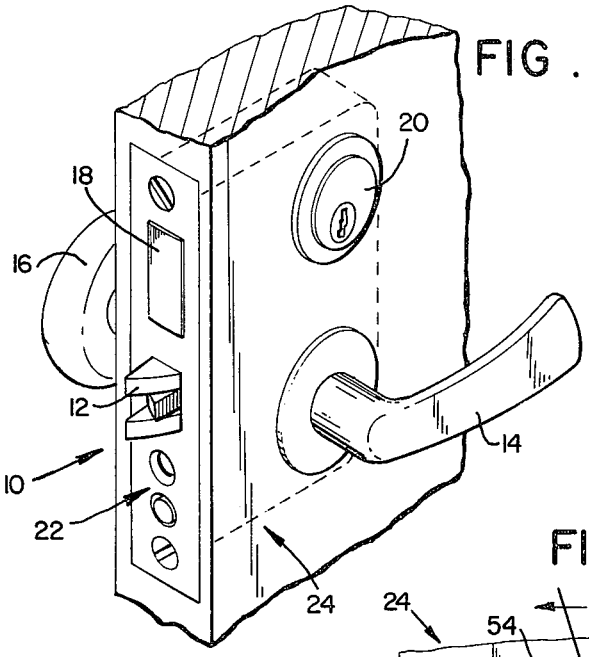
FIG. 1 is a fragmentary perspective view and shows a mortise lock embodying the present invention mounted on an associated door.
Figure 2:
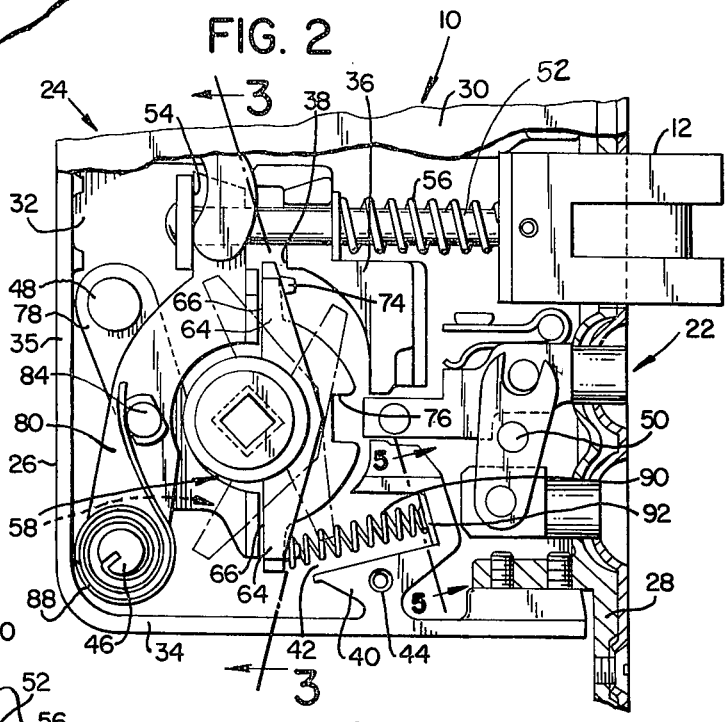
FIG. 2 is a somewhat enlarged fragmentary side elevational view of the mortise lock of FIG. 1 as viewed from the inner side and shown with a portion of the lock case cover broken away to reveal structure within the case.
Figure 5:
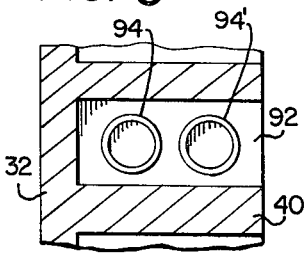
FIG. 5 is a somewhat enlarged fragmentary sectional view taken along the line 5—5 of FIG. 2.
Figure 3:
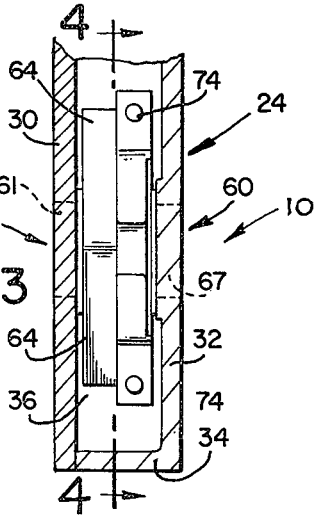
FIG. 3 is a fragmentary sectional view taken generally along the line 3—3 of FIG. 2.

Turning now to the drawing and referring particularly to FIGS. 1–3, a mortise lock embodying the present invention and indicated generally by the reference numeral 10 is shown mounted in operational position on a door. The lock 10 is of a reversible type, has an entrance function, and includes an anti-friction latch bolt 12 retractable from the outer side of the door by a lever handle 14 which extends in the direction of the hinged end of the door, as conventional in installations of this type. A two direction knob 16 mounted on the inner side of the door is operable at all times to retract the latch bolt in response to rotation in either direction. The entrance lock 10 also includes a deadbolt 18 operated from the outer side of the door by a lock cylinder 20, which is also operable to retract the latchbolt 12. The deadbolt 18 may be operated from the inner side of the door by a conventional turn piece (not shown). A stop works indicated generally at 22 is provided for locking or disabling the outer lever handle 14, in a manner well known in the art.

Considering now the lock 10 in further detail, the illustrated lock comprises a modified form of a RUSSWIN TEN STRIKE SERIES Mortise Lock, manufactured by Russwin Division of Emhart Corporation, Berlin, Connecticut, and has an entrance function. The lock case indicated generally by the numeral 24 is preferably cast metal and includes a body 26, a front 28 and a cover or cap 30, which, as shown, forms the inner side wall of the case. The body casting 26 includes an outer side wall 32 and integral top, bottom and rear walls, the bottom and rear wall being shown and respectively indicated by the numerals 34, and 35. The body 26 further includes a plurality of integrally cast bosses and stumps which project from the side wall 32 into the case 24 to provide support for various parts of the latch and lock mechanisms as will be hereinafter further discussed. A boss 36 is provided to guide the latchbolt 12 for movement between its projected and retracted positions and has a rearwardly facing abutment surface 38 thereon for a purpose to be hereinafter discussed. Another boss 40 cooperates with the boss 36 to provide a guide for a part of the stop works 22. The boss 40 extends between the side walls 30 and 32 and includes a rearwardly opening spring receiving recess 42. A tapped hole 44 formed in the boss 40 receives a fastener (not shown) to secure the cap 30 in assembly with the body 26. The body 26 further includes integral stumps such as indicated at 46, 48 and 50 which project inwardly from the outer side wall 32 to provide pivotal support for other operating parts of the latch and lock mechanisms.

The front 28 is secured to the top and bottom walls of the body 26 and is adjustable relative thereto to conform to the bevel of doors of either hand. A conventional scalp overlies the front 28 to provide finish trim. The reversible anti-friction latch bolt 12 is supported in an aperture in the front 28 and has a tailpiece 52 which projects rearward through a guide slot in the boss 36. A tail plate mounted at the rear of the tailpiece 52 has a forwardly facing abutment surface 54 thereon. A compression spring 56 surrounds the tailpiece 52 and acts between the boss 36 and the latch bolt 12 to bias the latch bolt to its projected position, as it appears in FIG. 2.

Figure 4:
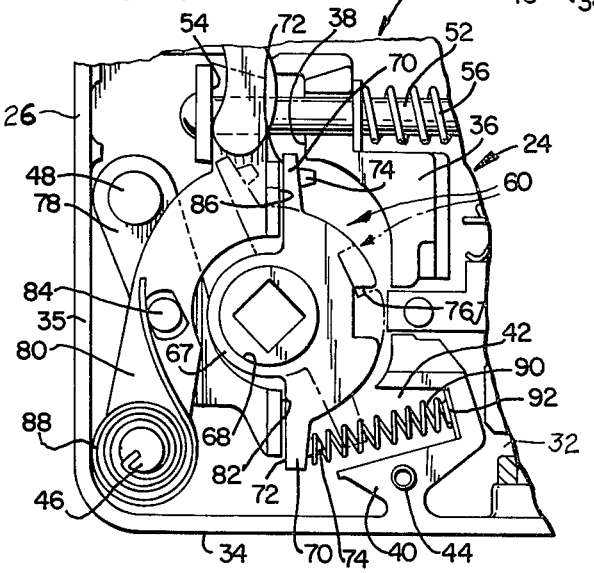
FIG. 4 is a fragmentary sectional view taken along the line 4—4 of FIG. 3.

Inner and outer rollback hubs respectively generally indicated at 58 and 60 are journalled for independent coaxial rotation within the case 24. The inner hub 58 is symmetrical about an axial plane, has a generally cylindrical central portion 61 which is journalled in a bearing aperture in the side wall 30 as best shown in FIG. 3. The central portion has a non-circular central aperture therein for receiving an operating spindle. Upper and lower arms 64, 64 extend radially outwardly in generally diametrically opposite directions from the central portion 61. Each arm 64 has a rearward facing bearing surface 66 thereon. The other hub 60, best shown in FIG. 4, is also symmetrical about an axial plane and includes a generally cylindrical central portion 67 which is journalled in a bearing aperture in the outer wall 32 and has a non-circular aperture therein to facilitate non-rotatable connection with an operating spindle associated with the lever handle 14. The inner end of the hub has a shallow cylindrical clearance recess 68 therein, as shown in FIG. 4, to provide operating clearance for the inner and outer operating spindles which are customarily of different size and rotatably connected at their inner ends, as is well known in the art. The inner hub 58 is preferably provided with a similar clearance recess at its inner end, but not shown. Upper and lower arms 70, 70 extend outward in generally diametrically opposite directions from the central portion 67. Each arm 70 has a rearward facing bearing surface 72 thereon. Each arm 70 also has an integral forward projecting spring retaining nub 74 thereon. A forward opening notch 76 formed in the central portion 67 receives the rear end portion of the upper or long stop button which comprises a part of the stop works 22. The stop works may be employed to lock the outer hub and the lever handle 14 against rotation, as is well known in the art. It should be noted that the arms 70, 70 on the outer hub 60 are of somewhat greater length than the corresponding arms 64, 64 on the inner hub 58. The abutment surface 38 is disposed in the path of the upper arm 70. Thus, the outer hub 60 is supported for angular movement in a counterclockwise direction from its full line positions in FIGS. 2 and 4. However, angular movement in a clockwise direction is limited by engagement of the upper arm 70 with the abutment surface 38.

Angular movement of one or the other of the hubs 58 and 60 is transmitted to the latch bolt 12 to effect retraction thereof by a sissors linkage which includes levers 78 and 80. The lever 78 is formed from flat metal and pivoted on the stump 48. The lower or free end of the lever 79 is bent outwardly from the plane of the lever to define a bearing surface 82 for engaging the bearing surfaces 68 and 72 on the lower arms 64 and 70. A pin 84 is carried by the lever 78 intermediate its ends. The other lever 80 is also formed from flat metal and is journalled on the stump 46 and crosses the lever 78 in generally overlying relation. A slot formed in the lever 80 intermediate its ends receives the pin 84 therethrough. The upper or free end of the lever is disposed generally adjacent the abutment surface 54. A tab bent outwardly from the lever 60 defines a forwardly facing bearing surface 86 for engaging the bearing surfaces 68 and 72 on the upper arms 64 and 70. A light sprial spring 86 mounted on the stump 46 has a free end portion which engages the pin 84 to exert relatively uniform biasing force on the upper and lower arms associated with the hubs 53 and 60. Thus, the bearing surfaces 82 and 88 respectively cooperate with the bearing surfaces 66, 66 on the lower and upper arms 64, 64 to provide balanced action or relatively uniform resistance to rotation of the inner hub 58 in either direction. This condition is desirable with respect to the inner hub 58 which is operated by the knob 16. Thus, the knob 16 has a balanced action or uniform resistance to rotation in either direction. However, a different condition exists with respect to the outer hub 60 and its associated operating lever 14. Since the lever handle 14 offers substantially greater mechanical advantage than the knob 16, it is generally desirable that the lever handle have a somewhat greater resistance to angular movement than the knob. It is also generally desirable that means be provided to compensate for the moment of the lever handle 14, which results from its center of gravity being displaced a substantial radial distance from its axis, so that the lever handle will not sag in its normal or inactive position, as it appears in FIG. 1.

In accordance with the invention, an auxiliary biasing spring 90 is employed to provide additional biasing force to resist rotation of the outer hub 60 in a counterclockwise direction from its full line positions in FIGS. 2 and 4. The spring 90 comprises a compression spring received within the recess 42. Since the case 24 is preferably made from cast metal, the problem of providing integral nubs or other spring retaining means on the cast body 26 is overcome by the provision of a spring seat plate 92 which is supported in fixed position within the recess 42 to extend between the sidewalls 30 and 32. The plate 92 is preferably formed from flat metal and has two eyelets or nubs 94 and 94' formed thereon. In the illustrated case, one end of the spring 92 is disposed on the nub 94 and the opposite end of the spring receives the upper nub 74. The spring 90 biases the outer hub 60 in a clockwise direction, as shown in FIGS. 2 and 4, and causes the upper arm 70 to engage the abutment 38 on the case. Thus, the spring 90 cooperates with the hub 60 and the abutment 38 to retain the lever handle 14 in its inactive position, as it appears in FIG. 1.

The present invention has been illustrated with reference to a mortise lock operated by an inner knob and an outer lever handle, However, it will now be evident that the lock 10 may be readily converted to lever handle operation from either or both sides of the door, if desired. Thus, for example, the position of the knob 16 and the lever arm 14 may be reversed by simply reversing the positions of the hubs 58 and 60 and relocating the spring 90 to act between the lower nub 74 on the hub 60 and the spring retaining nub 94' on the plate 92. It will be further apparent that the lock 10 may be adapted for lever handle operation from both side of the door by providing a pair of springs 90, 90 and a pair of hubs 60, 60.

Referring now to FIGS. 6–10, another mortise lock embodying the invention is designated generally at 10*a*. The illustrated lock 10*a* is also reversible, has an entrance function, and is arranged for lever handle operation from its outer side and knob operation from its inner side. An auxiliary spiral spring 90*a* provides the additional reactive torque required by the outer lever handle.

Figure 10:
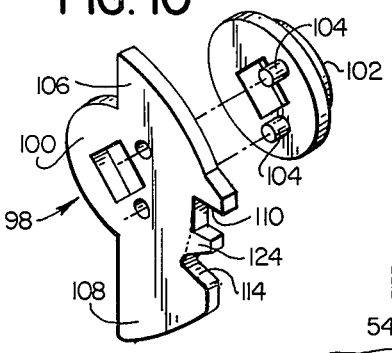
FIG. 10 is an exploded perspective view of the outer hub of the mortise lock of FIG. 6.
Figure 9:
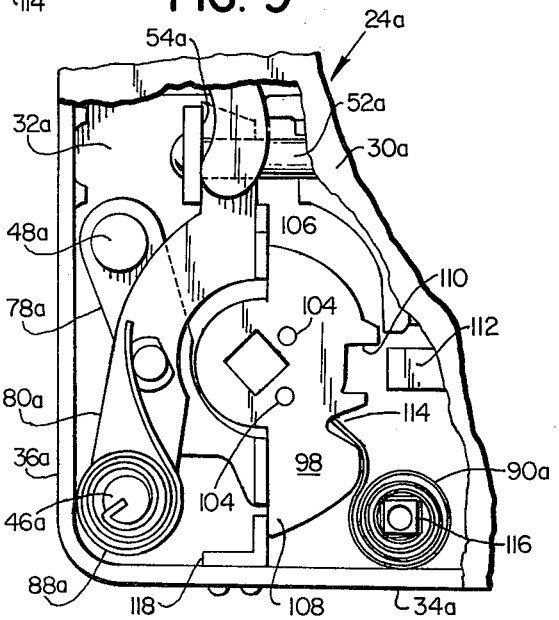
FIG. 9 is a fragmentary sectional view taken along the line 9—9 of FIG. 7.

The lock case, indicated generally at 24*a*, is preferably formed from flat metal and includes a body 26*a* and a cover 30*a*, which, is shown, forms the inner side wall of the case. The illustrated portion of the body 26*a* includes an outer side wall 32*a* and integral bottom and rear walls respectively indicated 34*a* and 36*a*. A spring projected latch bolt, substantially identical to the latch bolt 12 previously described, is supported in the case and has a tailpiece 52*a* which includes a forwardly facing abutment surface 54*a*. The lock 10*a* has inner and outer rollback hubs journalled for independent coaxially rotation within the case 24*a* to operate a sissors linkage which includes levers 78*a* and 80*a*. The latter two levers are substantially identical to the levers 78 and 80 previously described and are respectively supported on pivot studs 46*a* and 48*a* staked to or otherwise mounted in fixed position on the side wall 32*a*. As in the previously described embodiment, a spiral spring 88*a* serves to bias the levers 78*a* and 80*a* toward engagement with the inner and outer hubs. The inner rollback hub, which provides knob operation, is designated at 58*a* and is or may be substantially identical to the hub 58 previously described. However, the outer rollback hub indicated generally at 98, and best shown in FIGS. 9 and 10, is particularly adapted to cooperate with the sprial spring 90*a* and differs in its construction and arrangement from the corresponding part of the previously described embodiment 10. Preferably, and as shown, the outer hub 98 is made in two parts, and includes a main body 100 and a central hub 102. The central hub part is adapted to be journalled in an associated side wall of the case 26*a* and is symmetrical about an axial plane so that it may be assembled with the body part 100 on either side thereof. Drive pins 104, 104 carried by the central hub 102 are received in associated apertures in the body 100 when the two parts are assembled, as best shown in FIG. 10. Thus, the hub 98 is reversible and may be journalled in either of the side walls 30*a* and 32*a* to suit the particular requirements of an associated door. The body 100 comprises a rollback and has upper and lower arms respectively indicated at 106 and 108 which define bearing surfaces for respective engagement with the levers 78*a* and 80*a* as shown in FIG. 9. A forwardly opening notch 110 is formed in the body 100 to receive the inner end portion of an upper or long stop member designated 112 which comprises a part of a stop works similar to the stop works 22 illustrated in FIG. 2. Another notch 114, below the notch 110, is provided to cooperate with the spring 90*a* as hereinafter discussed.

The spiral spring 90*a* has an inner end which closely surrounds a non-circular stump 116 staked or otherwise suitably secured to the side wall 32*a*. The free end of the spiral spring is disposed within the notch 114, so that the latter spring acts between the case 26*a* and the hub 90 to bias the hub in a clockwise direction, as it appears oriented in the drawings. A generally L-shaped stop member 118 secured to the lower wall 34*a* by suitable fasteners, substantially as shown, engages the bearing surface on the lower arm 108 to limit rotation of the hub 98 in a clockwise direction.

Figure 6:
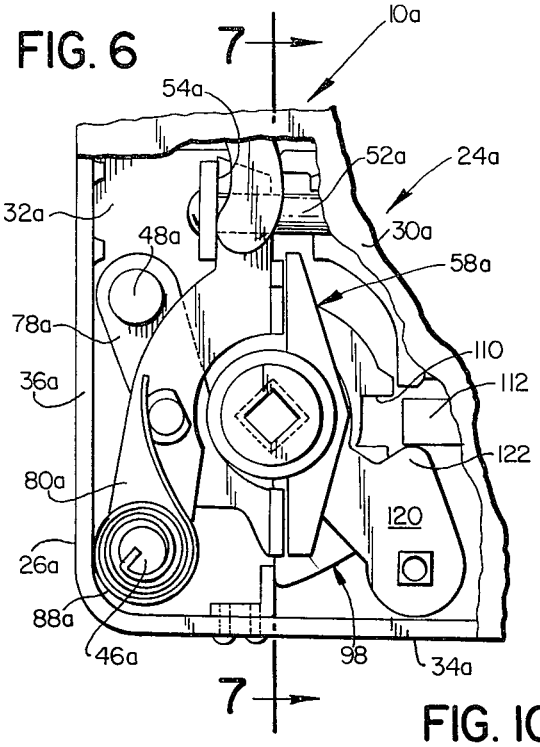
FIG. 6 is a fragmentary side elevational view of another mortise lock embodying the present invention and shown with a portion of the lock case cover broken away.
Figure 7:
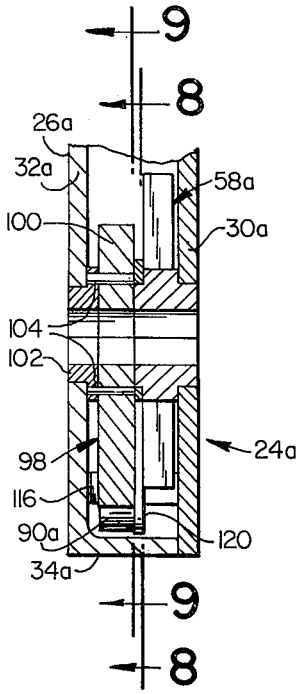
FIG. 7 is a fragmentary sectional view taken generally along the line 7—7 of FIG. 6.
Figure 8:
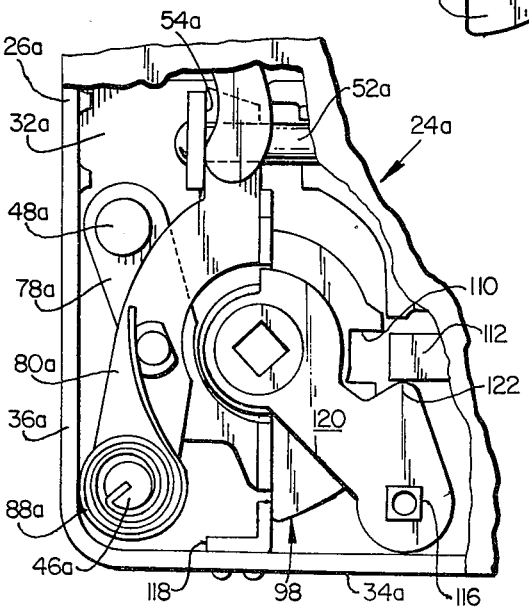
FIG. 8 is a fragmentary sectional view taken along the line 8—8 of FIG. 7.

A relatively thin spacer 120 received on the stump 116 is disposed between and separates the hubs 58*a* and 98, as shown in FIGS. 6–8. The spacer 120 has an upwardly projecting portion 122 which provides support for the inner end of the movable stop member 112. The spring 90*a* is disposed adjacent the spacer 120 and is retained in an associated side of the case 24*a* by the spacer.

The spiral spring 88*a* acting through the lever 80*a* and the spiral spring 90*a* acting directly on the hub 98 cooperate to bias the hub 98 in a clockwise direction to resist the action of a lever handle, such as the handle 14 (FIG. 1), associated with the outer hub 98. The hub 98 may be reversed, as discussed, to enable lever handle operation from the inner side of the door or, if desired, the hub 58*a* may be replaced by another hub similar to the hub 98 and another spring 90*a* provided to enable lever handle operation from both sides of a door.

When the lock 10 is set up for an entrance function and has an operating lever on its inner side, it is preferable that the inner operating lever be operable at all times to retract the latch bolt. An inner hub similar to the hub 98 is provided, however, a portion of the hub main body 100 which separates the notches 110 and 114 is removed as shown in FIG. 10, where the portion to be removed is designated by the numeral 124. Removal of the portion 124 allows the inner hub 98 to rotate in a counterclockwise direction relative to the stop member 112 to retract the latch bolt when the latter stop member is in its locked position relative to the outer hub.

I claim:

1. In a mortise latch having a case including opposing side walls, a latch bolt supported in the case for movement between projected and retracted positions relative thereto, a latch bolt spring normally biasing the latch bolt to its projected position, inner and outer hubs supported in the case between the side walls and journalled for independent coaxial angular movement relative to said case and each other, a linkage for retracting the latch bolt in response to angular movement of either of the hubs, and a first spring acting between the linkage and the case for yieldably resisting angular movement of either and both of the hubs, the improvement comprising means in said case for limiting angular movement of at least one of said hubs in one direction relative to said case, said one hub having a radially extending arm, a second spring in said case engaging and acting between said arm and said case for yieldably resisting angular movement of said one hub in the other direction, said second spring comprising a spiral spring having one end secured in fixed position relative to said case and another end engaging said one hub and biasing it in said one direction, and a spacer having one portion disposed between said inner and outer hubs and another portion extending outward beyond said hubs and disposed adjacent said spiral spring, said other portion retaining said spiral spring in an associated side portion of said case.

2. In a mortise latch as set forth in claim 1 the combination wherein said means for limiting angular movement of said one hub comprises an abutment surface on said case.

3. In a mortise latch as set forth in claim 2 the combination wherein said one hub has a pair of arms extending radially outwardly in generally opposite directions therefrom and said abutment surface is disposed in the path of one of said arms.

4. In a mortise latch as set forth in claim 3 the combination wherein said one hub comprises two separable parts.

5. In a mortise latch as set forth in claim 4 the combination wherein one of said parts is journalled in an associated side wall of said case.

6. In a mortise lock as set forth in claim 1 the combination wherein said means for limiting the angular movement of said one hub comprises a stop fastened to said case for engagement by said one hub.

7. In a mortise latch as set forth in claim 1 the combination wherein said inner and outer hubs are journalled for coaxial rotation about an axis extending transversely of said case, each of said hubs is journalled in an aperture in an associated one of said side walls, said one hub has a pair of arms extending radially outwardly therefrom, said means for limiting angular movement comprises a stop secured to said case and engageable with one of said arms and said spiral spring acts between the other of said arms and said case.

8. In a mortise latch as set forth in claim 1 the combination wherein said other end is disposed generally adjacent said other portion in all angular positions of said one hub relative to said case.

9. In a mortise latch as set forth in claim 1 the combination including means for retaining said spacer in fixed position relative to said case.

10. In a mortise latch as set forth in claim 9 the combination wherein said means for retaining said spacer in fixed position comprises one of said hubs and means for securing said one end in fixed position relative to said case.

11. In a mortise latch as set forth in claim 10 the combination wherein said means for securing said one end comprises a stump secured to one of said side walls and extending through an opening in said other portion of said spacer.

12. In a mortise latch having a case, a latch bolt supported in the case for movement between projected and retracted positions relative thereto, inner and outer hubs journalled in the case for independent angular movement relative to said case and each other, means for retracting the latch bolt in response to angular movement of either of the hubs, first biasing means yieldably resisting angular movement of either and both of the hubs, and stop works including a stop member movable generally toward and away from said hubs between locking and releasing positions relative to at least one of said hubs, the improvement comprising means in said case for limiting angular movement of at least one of said hubs in one direction relative to said case, second biasing means in said case for yieldably resisting angular movement of said one hub in the other direction, and a spacer partially disposed between and separating said inner and outer hubs and providing support for an associated portion of said movable stop member.

13. In a mortise latch having a case, a latch bolt supported in the case for movement between projected and retracted positions relative thereto, a latch bolt spring normally biasing the latch bolt to its projected position, inner and outer hubs journalled in the case for independent angular movement relative to said case and each other, a linkage for retracting the latch bolt in response to angular movement of either of the hubs, a first spring acting between the linkage and the case for yieldably resisting angular movement of either and both of the hubs, and a stop works including a stop member movable generally toward and away from said hubs between locking and releasing positions relative to at least one of said hubs, the improvement comprising means in said case for limiting angular movement of at least one of said hubs in one direction relative to said case, said one hub having a radially extending arm, a second spring in said case engaging and acting between said arm and said case for yieldably resisting angular movement of said one hub in the other direction, and a spacer partially disposed between and separating said inner and outer hubs and providing support for an associated portion of said movable stop member.

* * * * *

UNITED STATES PATENT OFFICE

CERTIFICATE OF CORRECTION

Patent No. 4,071,270 Dated January 31, 1978

Inventor(s) Gordon A. Alexander

It is certified that error appears in the above-identified patent and that said Letters Patent are hereby corrected as shown below:

In the Abstract, line 8, "movement" should be --moment--.

Column 3, line 56, "other" should be --outer--.

Column 4, line 26, "79" should be --78--.

Column 4, line 28, "68" should be --66--.

Column 4, line 36, "60" should be --80--.

Column 4, line 37, "68" should be --66--.

Column 4, line 38, "sprial" should be --spiral--.

Column 4, line 39, "86" should be --88--.

Column 4, line 42, "53" should be --58--.

Column 4, line 43, "88" should be --86--.

Column 5, line 39, "is" should be --as--.

Signed and Sealed this

Thirtieth Day of May 1978

[SEAL]

Attest:

RUTH C. MASON
Attesting Officer

LUTRELLE F. PARKER
Acting Commissioner of Patents and Trademarks